US008009115B2

(12) United States Patent
Walton et al.

(10) Patent No.: US 8,009,115 B2
(45) Date of Patent: Aug. 30, 2011

(54) RECONFIGURABLE ANTENNA USING ADDRESSABLE CONDUCTIVE PARTICLES

(75) Inventors: Eric K. Walton, Columbus, OH (US); Bruce G. Montgomery, Columbia, MD (US)

(73) Assignees: The Ohio State University Research Foundation, Columbus, OH (US); Syntonics LLC, Columbia, MD (US)

( * ) Notice: Subject to any disclaimer, the term of this patent is extended or adjusted under 35 U.S.C. 154(b) by 811 days.

(21) Appl. No.: 12/032,261

(22) Filed: Feb. 15, 2008

(65) Prior Publication Data

US 2011/0050524 A1 Mar. 3, 2011

Related U.S. Application Data

(60) Provisional application No. 60/890,224, filed on Feb. 16, 2007.

(51) Int. Cl.
*H01Q 3/00* (2006.01)

(52) U.S. Cl. ..... 343/757; 343/700 MS; 343/725; 343/876

(58) Field of Classification Search ..... 343/757, 343/700 MS, 909, 725, 876
See application file for complete search history.

(56) References Cited

U.S. PATENT DOCUMENTS

| | | | | |
|---|---|---|---|---|
| 7,046,198 | B2 | 5/2006 | Sakiyama et al. | |
| 7,250,909 | B2 | 7/2007 | Fujishima et al. | |
| 7,471,247 | B2 | 12/2008 | Saily et al. | |
| 7,561,109 | B2 * | 7/2009 | Walton et al. | 343/700 MS |

* cited by examiner

*Primary Examiner* — Jacob Y Choi
*Assistant Examiner* — Shawn Buchanan
(74) *Attorney, Agent, or Firm* — Dinsmore & Shohl LLP

(57) ABSTRACT

An antenna made up of small addressable conductive segments, or pixel elements, located in a dielectric space positioned over a two-dimensional pixel element actuator is presented. The small pixel elements can be actuated in less than a millisecond by the actuator to form patterns that create an array of patch antennas and associated transmission lines on the upper surface of the dielectric space. The pixel elements can be formed using small movable conductive particles such as metal flakes or metal chips.

20 Claims, 2 Drawing Sheets

RECONFIGURABLE ANTENNA USING ADDRESSABLE CONDUCTIVE PARTICLES

CROSS-REFERENCE TO RELATED APPLICATIONS

This application claims the benefit of U.S. Provisional Application Ser. No. 60/890,224, filed Feb. 16, 2007. This Application is related to U.S. patent application Ser. No. 12/032,265, filed Feb. 15, 2008 and U.S. patent application Ser. No. 12/032,269, filed Feb. 15, 2008.

GOVERNMENT LICENSE RIGHTS

The U.S. Government has a paid-up license in this invention and the right in limited circumstances to require the patent owner to license others on reasonable terms as provided for by the terms of contract No. W9113M-04-P-0061 awarded by U.S. Army Space and Missile Defense Command.

BACKGROUND OF THE INVENTION

The present invention relates to a reconfigurable antenna using addressable conductive particles.

In general, it is possible for an antenna to be made of conductive paths separated from a ground plane by a dielectric space. Such antennas can be built as a patch array with operational frequency, main beam direction and even main beam shape by printing a pattern of the transmission lines, power dividers and patch antennas on a surface above a dielectric.

However, in the past, the method of rapidly reconfiguring these types of antennas has been very restrictive. Typically, a set of radiating elements was connected to a transmission line with amplitude and phase shift elements embedded in the line. An alternative technique has been to use antenna modules with embedded phase and gain characteristics. Both of theses designs suffer from limitations due to the fixed geometry of the array of radiating elements and the configuration of the transmission lines.

Therefore, there is a need for an antenna that can be rapidly reconfigured to change its operational frequency band, its pointing angle, gain, bandwidth and its polarization in less than a millisecond. This patent describes a method for rapid reconfiguration through the use of small conductive segments, or pixel elements, to accomplish these changes.

BRIEF SUMMARY OF THE INVENTION

According to the present invention, an antenna made up of small addressable conductive segments, or pixel elements, located in a contained dielectric space positioned over a two-dimensional actuator is presented. The small pixel elements can be actuated by the actuator that is controlled by a processor to move within the dielectric space in less than a millisecond to form patterns that create an array of patch antennas and associated transmission lines on the upper surface of the dielectric space.

In accordance with one embodiment of the present invention, the pixel elements can be formed using small movable conductive particles such as metal flakes or metal chips.

Accordingly, it is a feature of the embodiments of the present invention to be able to rapidly reconfigure the characteristics of an antenna in less than a millisecond. Other features of the embodiments of the present invention will be apparent in light of the description of the invention embodied herein.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION

In the following detailed description of the embodiments, reference is made to the accompanying drawings that form a part hereof, and in which are shown by way of illustration, and not by way of limitation, specific embodiments in which the invention may be practiced. It is to be understood that other embodiments may be utilized and that logical, mechanical and electrical changes may be made without departing from the spirit and scope of the present invention.

According to the present invention, an antenna array can be built to be electronically configured and reconfigured in less than a millisecond. The transmission lines can be modified to steer the beam and the patch geometry can be modified to shift the operational frequency. The number, disposition, shape, size and feed point of the patches can be rapidly modified to change the array shape and gain as well as the polarization. In a swept-frequency radar embodiment, the resonant frequency of the antenna array can be tracked with the instantaneous frequency of the radar. Further, since the antenna can be half-duplex, the antenna can switch from the desired transmit characteristic to the desired receive characteristic as needed.

The transmission lines (e.g., striplines and microstrips) and antenna (e.g., patches or other radiating structures) can be formed, pixel by pixel, by forming conductive patterns on the upper surface of a contained dielectric space. In one embodiment, the conductive patterns can be formed using conductive particles, or pixel elements, that are moved from a ground plane located at the bottom, or lower surface, of the dielectric space (i.e., the "off" state) to the top, or upper surface, of the dielectric space (i.e., the "on" state). The ground plane can be any grounded surface, planar or non-planar. The pixel elements can be moved by a two-dimensional actuator located under the dielectric space. Each pixel element can be individually addressed to be either "on" or "off."

The conductive pixel elements can be metal flakes or metal patches that can be actuated, or triggered, to move in the dielectric space by the two-dimensional actuator by any suitable method known in the art such as, for example, magnetic or electrostatic forces, pneumatic pressure, pneumatic vacuum, mechanical actuators, micro-electro-mechanical (MEM) actuators. In one embodiment, the dielectric space can be gas or a fluid dielectric and the particles can be actuated, or triggered, to move using magnetic or electrical forces as known in the art.

Figure 1:
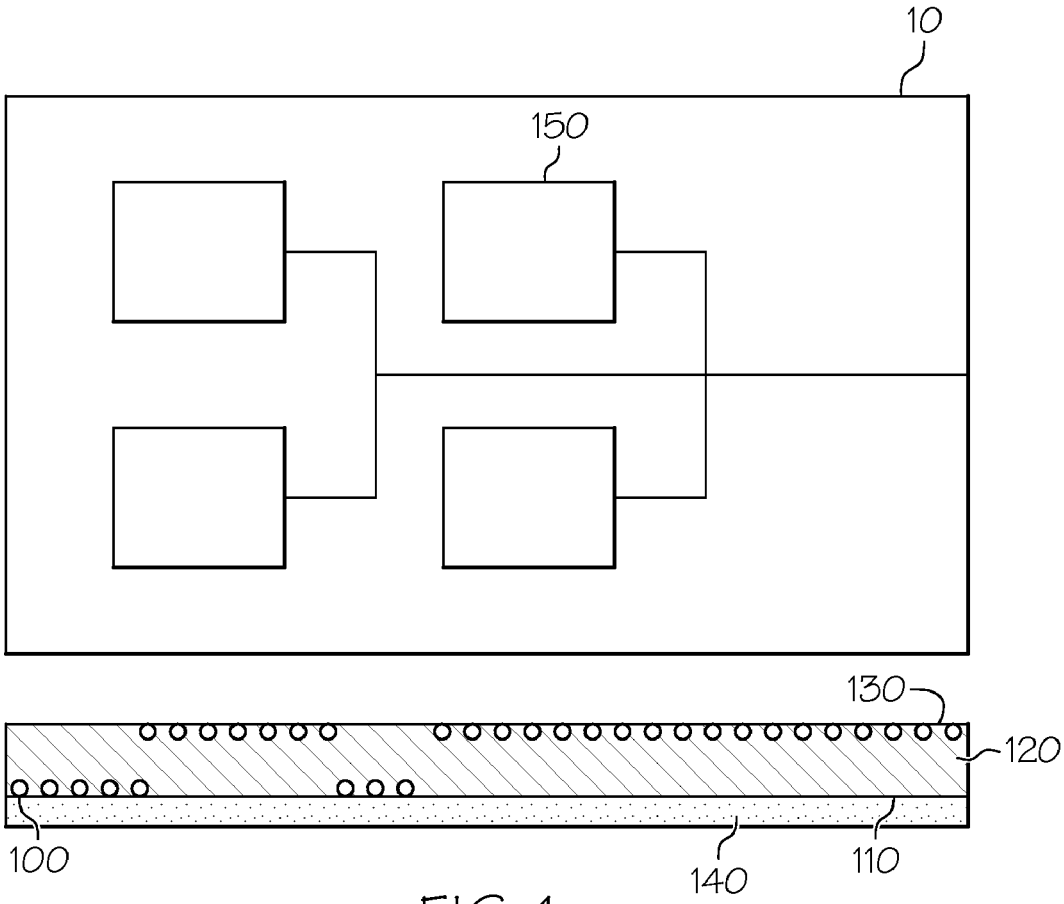
FIG. 1 illustrates the concept of moving particles in a liquid dielectric according to an embodiment of the present invention.

One embodiment of an antenna 10 is illustrated in FIG. 1. In this embodiment, a layer of conductive particles, or pixel elements, 100 can be driven, or actuated, from the ground plane 110, or the lower surface of the dielectric space, of a two-dimensional grid structure by an actuator 140 through a contained dielectric space 120 to the upper surface 130, or top, of the dielectric space 120. The two-dimensional actuator 140 can be a grid of electrostatic plates or very small magnetic loops that can be used to perform the actuation function. A processor (not shown) can be used to determine which pixel elements 110 the actuator 140 moves. The antenna 10 can be deposited onto the upper, or top, surface 130 of the dielectric space 120 much like the images displayed by a liquid crystal display (LCD) screen.

Figure 2:
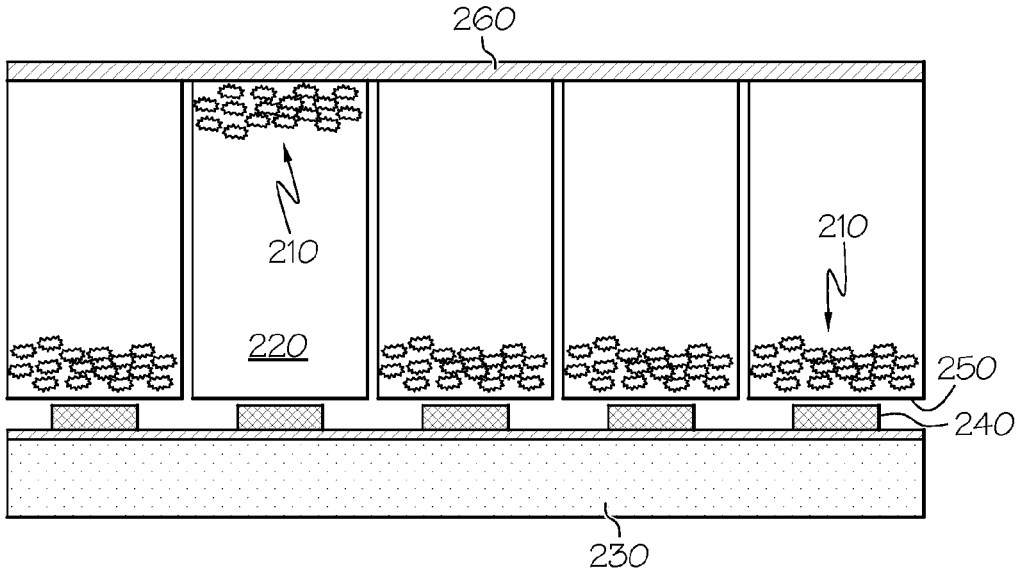
FIG. 2 illustrates conductive particles in gas or liquid-filled cells according to an embodiment of the present invention.

In another view of this embodiment, shown in FIG. 2, the electrically conductive particles, or pixel elements, 210 can be suspended in a contained two-dimensional liquid or gas dielectric space 220 of a grid of individual cells. The individual cells of the dielectric space 220 can be turned on, or actuated, by the use of magnetic or electrostatic forces 230 to move the conductive particles 210 from the ground plane 250 to the upper surface 260 of the dielectric cells 220 through the use of an actuator 240. A processor (not shown) can control the actuator 240 to actuate the pixel elements 100 in the individual cells to form the antenna pattern on the upper surface 260 of the dielectric space 220. The bottom layer 250 can be the ground plane. The configuration, or pattern, of the antenna array and transmission lines can be modified by the processor in less than a millisecond.

In one version of this embodiment, very small electrically conductive metal flakes such as, for example, copper or gold, can be used as the pixel elements to form programmable antenna arrays and transmission lines. In this embodiment, a two-dimensional array or grid of very small dielectric space compartments with a layer of metal flakes inside each compartment can be created. The metal flakes can be moved, or actuated, by the two-dimensional actuator from the bottom, or lower surface, of the dielectric compartment (i.e., turned off) to the top, or upper surface, of the dielectric compartment (i.e., turned on) using magnetic or electrostatic forces.

Figure 3:
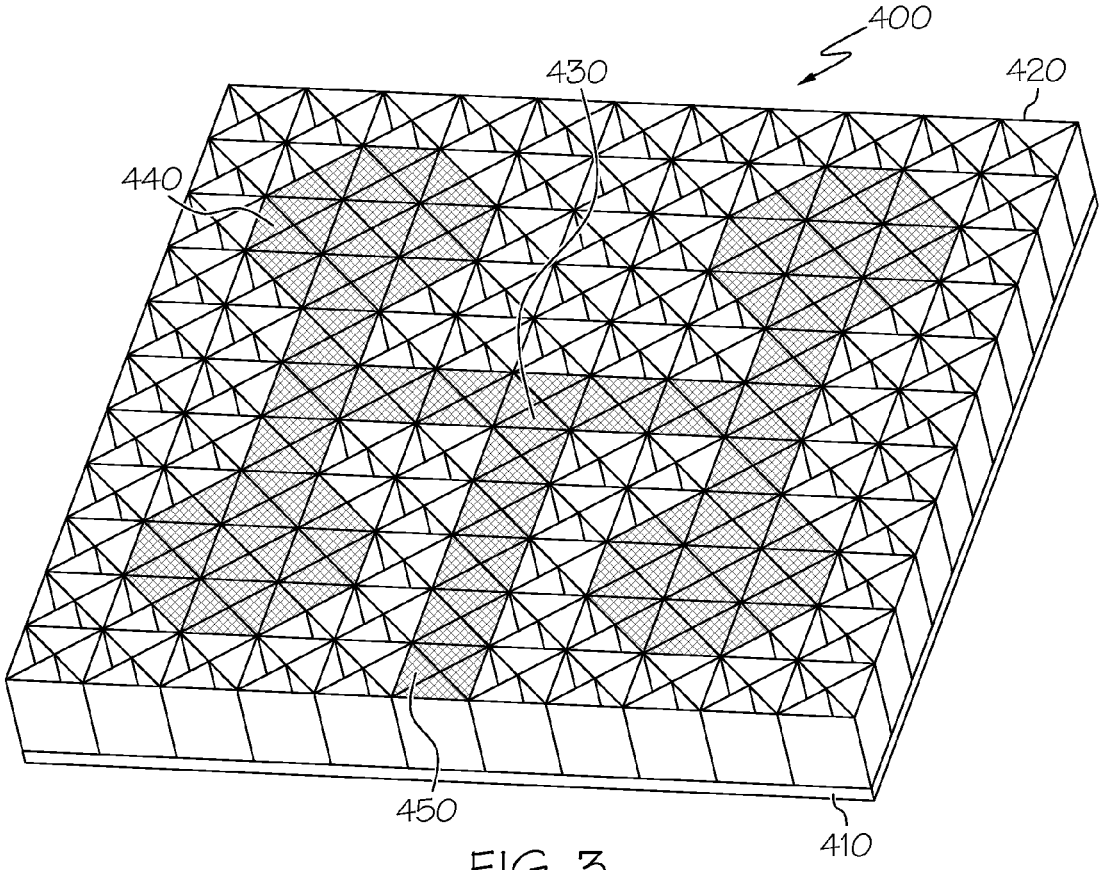
FIG. 3 illustrates a pixel particle concept according to an embodiment of the present invention.

In another version of this embodiment, shown in FIG. 3, a single patch or chip of conductive metal can be used to create the individual antenna pixel elements. In this embodiment, a two-dimensional array, or grid, of contained dielectric compartments, or cells, 400 with a single metal chip inside each compartment can be created. In one embodiment, the metal chips can be moved by the two-dimensional actuator (not shown) which is located under the dielectric compartments 400 from the ground plane 410 (i.e., the lower surface) of the dielectric compartment 400 (i.e., turned off) to the top 420 (i.e., the upper surface) of the dielectric compartment 400 (i.e., turned on) using magnetic or electrostatic forces. In another embodiment, if the metal chip is part of a magnetized layer, the actuator can be a magnetic solenoid to create magnetic fields to position the metal chip on or off within the compartments of the dielectric space 400.

Although the present invention has been described as moving the pixel elements up and down, it should be understood that the antenna arrays themselves can be in any suitable orientation. It is possible to position the antenna array and the transmission lines on their sides as well as upside down. The term "up" refers to moving the pixel element from the ground plane to the upper surface of the dielectric space. Likewise, the term "down" refers to the pixel elements moving from the upper surface of the dielectric space towards the ground plane. Additionally, for the purposes of describing and defining the present invention, formation of a material "on" a layer refers to formation in contact with a surface of the layer. Formation "over" a layer refers to formation above or in contact with a surface of the layer. Formation "under" a layer refers to formation under or in contact with a surface of the layer.

In one embodiment, a conductive cap can overlap the gap between the individual pixel element cells in the two-dimensional pixel element grid to increase the pixel element to pixel element capacitive coupling and thus improving the low frequency performance. The pixel element volume of the contained individual grid dielectric compartments can contain air, vacuum or a dielectric fluid. The upper surface of the pixel element volume can have a cover. A conductive shape can bridge the gap between neighboring pixel element dielectric compartments. When the conductive shape moves to the top, or upper surface, of the pixel element dielectric compartments (i.e., turns on), the conductive bridge can provide extra capacitive by coupling this pixel element dielectric compartments to the other neighboring "on" pixel elements dielectric compartments.

The geometry of the pixel element cell can be nearly any shape. The shape of the pixel element cell helps determine the nature shape of the bends and interconnects that can be created by the pixel element patterns. For example, in one embodiment, the pixel element dielectric compartments can be a 45-45-90 degree triangle. This shape can allow for 45 degree and 90 degrees turns more easily. In another embodiment, the pixel element dielectric compartments can be square. This shape can allow for 90 degree turns and can make interconnects simple and effective. In yet another embodiment, the pixel element dielectric compartments may be a hexagon. This shape can allow for 30 and 60 degree turns to be more effective and efficient. In still another embodiment, the pixel element dielectric compartments can be a shape that "tiles the plane" of the antenna array. This pixel element dielectric compartment shape can be optimized for improved geometrical flexibility and pixel-to-pixel capacitance. Additionally, the individuals pixel element dielectric compartments can be a variety of different shapes, depending on whether the pixel elements are to form an antenna element, a transmission line, a power splitter, or any other suitable application known in the art. Again, referring to FIG. 3, an example of the individual pixel element dielectric compartments containing a triangular pixel element particle that can be actuated from the ground plane 410 to the upper surface 420 of the dielectric compartment 400 to form the patch antenna array 440, power dividers 430, and transmission line 450 patterns of the antenna structure.

However, the size of the wavelength of the electromagnetic signal used by the antenna array can be a design constraint and should be taken into consideration. For example, the pixel element cannot be too large or the resulting transmission line can be potentially multimode and the structural control can be too limited. On the other hand, if the pixel element is too small, it can be difficult to control. Therefore, pixel element sizes of about 1/10 of a wavelength have been shown to be effective.

The antenna characteristics can be easily and quickly modified using this invention. For example, the direction of the antenna array beam can be determined by the phase distribution on the antenna array. Alternatively, the direction of the antenna beam can be determined by the differential phase or time delay along the transmission line. The location of the feed point can be shifted to shift the differential phase or time and, therefore, the main beam direction. The beamwidth can be determined by the size of the array and by the distribution of amplitude over the array. The beamwidth can be controlled using the pixel-based transmission lines. Polarization can be determined by how the antenna pixel elements are fed and by the geometry of the antenna pixel elements.

The frequency of operation of the antenna can be determined by the feed point and the size of the antenna. The size of the pixel-generated antennas, the number of array elements, and the power distribution over the array can be dynamically adjusted to yield the desired operational frequency.

Further, multiple antennas may use a single aperture. There is no electromagnetic limit to the number of feed points in the array aperture. It possible to have several feed points as well as several types of feeds (e.g., edge and thru-ground). Because of this, multiple radio/radar systems can use the same aperture.

Power distribution can be achieved by using directional couplers. Directional couples can be created by programming the geometry of the feed lines as is known in the art. Alternatively, power distribution can be achieved by using multiple transmission line impedance. The impedance of a transmission line can be controlled by the changing the width of the transmission line. For example, two transmission lines can be connected together so that a good impedance match can be achieved. Pixel element transmission lines can be created with various widths and thus various impedances. A single transmission line (i.e., the input) can be connected to two other transmission lines (i.e., the output) to form an effective feed system for a desired array antenna.

Additionally, stub tuning concepts can be used to further optimize the performance of the antenna array. Small stubs can be attached to the transmission lines as known in the art to tune components of the antenna arrays and to improve the feed point impedance match.

To feed the antenna from the edge, a coaxial to edge launch can be used to connect the antenna to the edge. Edge launch techniques and/or techniques that are known in the art can be used to excite the transmission edge. To feed the antennas from below the ground plane (i.e., away from the edge), techniques known in the art to feed transmission lines from below the ground plane can be used.

In summary, patterns can be generated on the face of specialized panels to create antenna arrays. The antennas can be operated at nearly any frequency and with antenna characteristics (e.g., gain, beam direction, beam width, polarization, etc.) that can be changed in less than a millisecond. Such an antenna can be used on space vehicles, aircraft and ground vehicles. In addition, such an antenna can be useful for any application where space and weight are limited and the need for communication, navigation and sensing are high. The programmability of the antenna characteristics means that such a panel antenna can be usable for many applications.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. An antenna structure, comprising:

a two-dimensional pixel element actuator;

a contained dielectric space configured over the two-dimensional pixel element actuator, the contained dielectric space having a upper surface and a lower surface; and addressable pixel elements located within the contained dielectric space, wherein the addressable pixel elements are movable between the upper surface and the lower surface of the contained dielectric space such that, when actuated, the addressable pixel elements located substantially at the upper surface of the contained dielectric space form a conductive pattern of transmission lines and antenna arrays and the addressable pixel elements located substantially at the lower surface of the contained dielectric space form a ground plane.

2. The antenna structure of claim 1, wherein the pixel elements are formed using conductive particles.

3. The antenna structure of claim 2, wherein the conductive particles are metal flakes.

4. The antenna structure of claim 2, wherein the conductive particles are a single metal chip.

5. The antenna structure of claim 2, wherein the conductive particles are gold, copper, other metal, or combinations thereof.

6. The antenna structure of claim 2, wherein the dielectric space comprises a vacuum, a gas, a fluid or combinations thereof.

7. The antenna structure of claim 2, wherein the conductive particles are positioned in the dielectric space by magnetic forces, electrostatic forces, pneumatic pressure, pneumatic vacuum, mechanical actuators, micro-electro-mechanical actuators or combinations thereof by the two-dimensional pixel element actuator.

8. The antenna structure of claim 1, further comprises:

a conductive cap configured to be located over the dielectric space that bridges neighboring pixel elements located at upper surface of the dielectric space.

9. The antenna structure of claim 8, further comprises:

inductive or capacitive elements in series with opposing faces of the conductive cap.

10. The antenna structure of claim 1, wherein the shape of the pixel elements comprises triangles, squares, hexagons, or any other suitable shape.

11. The antenna structure of claim 1, further comprising:

a processor configured to control the two-dimensional pixel element actuator and the location of the pixel elements within the dielectric space.

12. An antenna structure, comprising:

a two-dimensional pixel element actuator;

a contained dielectric space configured over the two-dimensional pixel element actuator, the contained dielectric space having a upper surface and a lower surface;

addressable pixel elements located within the contained dielectric space, wherein the addressable pixel elements are movable between the upper surface and the lower surface of the contained dielectric space such that, when actuated, the addressable pixel elements located substantially at the upper surface of the contained dielectric space form a conductive pattern of transmission lines and antenna arrays and the addressable pixel elements located substantially at the lower surface of the contained dielectric space form a ground plane; and a processor configured to control the two-dimensional pixel element actuator and the location of the addressable pixel elements within the contained dielectric space.

13. A method of rapidly configuring antenna structure, the antenna structure comprises a two-dimensional pixel element actuator, a contained dielectric space over of the two-dimensional pixel element actuator having a upper surface and a lower surface, a processor and addressable pixel elements comprised of movable conductive particles, wherein the method comprises:

creating antenna elements that form antenna arrays and transmission lines by forming conductive patterns on the upper surface of the dielectric space by actuating the pixel elements using the two-dimensional pixel element actuator to move the pixel elements from the lower surface of the contained dielectric space to the upper surface of the contained dielectric space.

14. The method of claim 13, further comprises:

reconfiguring the patterns of the antenna arrays and the transmission lines in less than a millisecond.

15. The method of claim 13, further comprises:

controlling beamwidth by using the formed transmission lines and antenna arrays.

16. The method of claim 13, further comprises:

determining polarization by the geometry of the pixel elements and how the pixel elements are fed.

17. The method of claim 13, further comprises:

adjusting the size of the antenna array, the number of elements in the antenna array and power distribution over the antenna array to yield a desired operational frequency and gain pattern.

18. The method of claim 17, further comprising:

using directional couplers to achieve the desired power distribution.

19. The method of claim 17, further comprising:

using multiple transmission line impedance to achieve the desired power distribution, wherein the impedance of a transmission line is determined by the width of the transmission line.

20. The method of claim 13, further comprising:

attaching small stubs to the transmission lines to optimize the performance of the antenna array.

* * * * *

UNITED STATES PATENT AND TRADEMARK OFFICE

CERTIFICATE OF CORRECTION

PATENT NO. : 8,009,115 B2
APPLICATION NO. : 12/032261
DATED : August 30, 2011
INVENTOR(S) : Eric K. Walton et al.

It is certified that error appears in the above-identified patent and that said Letters Patent is hereby corrected as shown below:

Column 1, line 16, cancel the text beginning with "The U.S. Government" to and ending "mand." in Column 1, line 21, and insert the following:

--This invention was made with government support under Contract No. W9113M-04-P-0061 awarded by U.S. Army Space and Missile Defense Command. The government has certain rights in the invention.--

Signed and Sealed this
Eleventh Day of October, 2011

David J. Kappos

David J. Kappos
*Director of the United States Patent and Trademark Office*